US007758436B2

(12) United States Patent
Reynolds

(10) Patent No.: US 7,758,436 B2
(45) Date of Patent: Jul. 20, 2010

(54) TRAINING DEVICE FOR SWINGING AND HITTING ACTIVITIES

(75) Inventor: Paul Reynolds, Macon, GA (US)

(73) Assignee: Launch Pad 39A, LLC, Perry, GA (US)

( * ) Notice: Subject to any disclaimer, the term of this patent is extended or adjusted under 35 U.S.C. 154(b) by 192 days.

(21) Appl. No.: 12/400,348

(22) Filed: Mar. 9, 2009

(65) Prior Publication Data

US 2009/0227384 A1 Sep. 10, 2009

Related U.S. Application Data

(60) Provisional application No. 61/034,948, filed on Mar. 7, 2008.

(51) Int. Cl.
*A63B 69/36* (2006.01)
*A63B 69/00* (2006.01)

(52) U.S. Cl. ..... 473/207; 473/212; 473/217; 473/458

(58) Field of Classification Search ..... 473/207, 473/208, 212, 213, 214, 215, 217, 218, 266, 473/270, 271, 274, 275, 276, 277, 422, 458, 473/464

See application file for complete search history.

(56) References Cited

U.S. PATENT DOCUMENTS 4,019,734 A 4/1977 Lee et al.
4,300,765 A 11/1981 Stringham
4,657,251 A 4/1987 Larsen
4,664,375 A 5/1987 Tetreault
4,681,318 A 7/1987 Lay
4,746,118 A 5/1988 Deveney
4,757,995 A 7/1988 Gallagher
4,826,165 A 5/1989 Socci
4,830,371 A 5/1989 Lay
4,867,448 A 9/1989 Judd
4,875,677 A 10/1989 Tetreault
5,037,094 A 8/1991 Johnson
5,106,085 A 4/1992 Lewy
5,114,142 A 5/1992 Gillespie
5,154,416 A 10/1992 Smull
5,174,564 A 12/1992 Young, III
5,188,365 A * 2/1993 Picard ..... 473/213
5,360,209 A 11/1994 Mollica
5,375,836 A 12/1994 Kiser (Continued)

FOREIGN PATENT DOCUMENTS

JP 10043349 A 2/1998

(Continued)

*Primary Examiner*—Nini Legesse
(74) *Attorney, Agent, or Firm*—Brian D. Bellamy

(57) ABSTRACT

A swinging and hitting training aid for batters and golfers having first, second and third attachment members that attach to a person's arm, calf, and foot respectively. The training aid includes an stretchable band of resistance tubing that provides a visible indicator between the first and second attachment members. The visible indicator includes a pair of abutting sleeves that form a separable cover about the resistance tubing. The visible indicator is connected to the first attachment member by a first tether, and the second attachment member is connected to the third attachment member by a second tether. The tethers may be fixed or variable length and may include resistance tubing of greater resistance than the stretchable band of the visible indicator portion of the device.

10 Claims, 6 Drawing Sheets

U.S. PATENT DOCUMENTS

| | | | | |
|---|---|---|---|---|
| 5,380,001 | A | 1/1995 | Socci | |
| 5,397,122 | A * | 3/1995 | Herridge, II | 473/212 |
| 5,428,846 | A | 7/1995 | Socci | |
| 5,433,435 | A | 7/1995 | Bourie | |
| 5,435,545 | A | 7/1995 | Marotta | |
| 5,597,160 | A | 1/1997 | Mims | |
| 5,601,286 | A | 2/1997 | Fierbaugh | |
| 5,640,719 | A | 6/1997 | Ritchie | |
| 5,704,856 | A | 1/1998 | Morse | |
| 5,839,978 | A | 11/1998 | Evangelist | |
| 5,893,806 | A | 4/1999 | Martinez | |
| 5,938,548 | A | 8/1999 | Upshaw | |
| 5,954,598 | A | 9/1999 | Carlson | |
| 6,050,907 | A | 4/2000 | Long | |
| 6,231,464 | B1 | 5/2001 | Curtis | |
| 6,296,582 | B1 | 10/2001 | Minniear | |
| 6,375,581 | B1 | 4/2002 | Urban | |
| 6,413,176 | B1 | 7/2002 | Martinez | |
| 6,435,990 | B1 | 8/2002 | Bradley | |
| 6,514,161 | B1 | 2/2003 | Minniear | |
| 6,514,163 | B2 | 2/2003 | Burns | |
| D476,052 | S | 6/2003 | Barth | |
| 6,612,943 | B2 | 9/2003 | Beers | |
| 6,755,755 | B2 | 6/2004 | Wah Loh | |
| 6,773,366 | B2 | 8/2004 | Gray | |
| 6,923,737 | B1 | 8/2005 | Walker | |
| 6,932,724 | B2 | 8/2005 | Socci | |
| 6,984,184 | B2 | 1/2006 | Gray | |
| 7,314,437 | B2 * | 1/2008 | Frappier | 482/124 |
| 2003/0178773 | A1 | 9/2003 | Meyer | |
| 2003/0224882 | A1 | 12/2003 | Mahoney | |
| 2004/0048696 | A1 | 3/2004 | Ciesar et al. | |
| 2004/0076939 | A1 | 4/2004 | Socci | |
| 2005/0043156 | A1 | 2/2005 | Wehrell | |

FOREIGN PATENT DOCUMENTS

| | | | |
|---|---|---|---|
| JP | 11099236 | A | 4/1999 |
| JP | 11309231 | A | 11/1999 |
| JP | 2000202082 | A1 | 7/2002 |
| JP | 2005246020 | A | 9/2005 |
| WO | 8501219 | A1 | 3/1985 |
| WO | 0238231 | A1 | 5/2002 |

* cited by examiner

TRAINING DEVICE FOR SWINGING AND HITTING ACTIVITIES

DOMESTIC PRIORITY CLAIM

The priority of U.S. Provisional Application No. 61/034,948 filed on Mar. 7, 2008 is claimed.

BACKGROUND OF THE INVENTION

1. Field of the Invention

The present invention relates to a training aid for swinging and batting activities that teaches proper technique. More particularly, the invention pertains to a training aid that provides a visual indication of proper rotation and extension and increases swing effectiveness.

2. Discussion of the Prior Art

Batter's sometimes lack power and need further development of their swing. Batters also need a training aid to assist in maintaining consistent form and gaining strength and improved mechanics. An aid is needed to teach young hitters in particular to feel the correct swing mechanics and understand and visualize those mechanics. There are two basic schools of thought when one discusses hitting. One is known as rotational, the other as linear. There are many devices which propose to increase power. However, all of these devices are related to the linear school of hitting. These aids are equipped to teach by strengthening the front arm, reducing the stride length, or both, rather than improving the strength and rotation of the backside. Ted Williams taught that the hips start the swing when hitting. After many years of trial and error, it has been shown that in fact the foot starts the swing because the foot starts the hip action taught by Ted Williams. Mr. Williams also taught that extension happens in front of the plate, rather than over the plate, with the elbow actually driving towards the pitch and initiating a point of contact in a positive power position.

Batters should extend the bat in front of the home plate, rather than over the plate and have back-side extension on the follow through. Proper extension increases distance and power when hitting. Therefore, a need exists for a resistance training aid to teach extension, the use of the correct muscles when batting and to increase strength in the lower and upper backside of the batter.

U.S. Pat. No. 4,019,734, issued to Lee, discloses an elastic resistance type exercising device having a single length of latex rubber surgical tubing whose two ends are formed into sized handle loops by the use of leather fasteners. The handle loops are sleeved with vinyl tubing, and plugs are inserted in each of the open ends of tubing, that have twice passed through the fasteners to form the loops, to prevent the tubing from being pulled out of the fasteners. A user grasps the handle loops or secures them about his ankles and pulls against the elastic resistance. Two additional flexible sleeves are slidably mounted over the portion of the elastic tubing between the fasteners.

U.S. Pat. No. 5,704,856, issued to Morse, discloses a device for training batters to properly shift weight to the back leg at the beginning of a swing and to shift weight to the front leg during a swing when striking the ball in baseball and similar games. The device includes a first strap for fastening to the leading leg just above the knee and a second strap for fastening to the leading wrist, "leading" being the side towards a pitcher. An elongated member connects the two straps and comprises an elastic portion and an adjustable length portion, which includes a separable buckle so that the elongated member can be separated without removing either strap. In use, straps are placed on the knee and wrist and the adjustable length portion is adjusted to be taut but not stretched with the batter in the "ready" position. At the start of a swing, the hands move back, stretching the elongated member to encourage weight movement to the back leg. When the forward swing and forward stride begin, the elongated member will be stretched forward to encourage weight shift to the forward leg. Proper weight shift will provide maximum batting stroke power.

U.S. Pat. No. 5,938,548, issued to Upshaw, discloses a simplified training device for improving the batting skill of a batter in baseball, has a pair of arm cuffs adapted to encircle the arms of the batter at a location above the elbows thereof, and a pair of elongate flexible tie straps which are coextensive with each other and which extend between and are connected to the arm cuffs. The device is so constituted that the tie straps can be easily adjusted as to their effective lengths. When the tie straps are taut, they positively limit the maximum space between the arm cuffs at the time that the batter's arms are raised, retracted position. The straps are flexible and capable of collapsing movement to enable the arm cuffs to approach each other as the batter's arms are swung from the raised, retracted position toward the extended, ball-striking position.

U.S. Pat. No. 6,984,184 issued to Gray, disclosed an apparatus for building muscle memory to develop a more rapid baseball swing and avoid casting of the hands and bat during the swing. Such apparatus includes a first attachment member connectable to an upper arm and a second attachment member connectable to an opposing forearm interposed by an elongated tether to be aligned along a forearm upon initially entering into a hitter's stance. A method for using such apparatus is also disclosed.

While each of the above devices disclose resistance training aids, these aids do not teach the proper extension of a batter in front of the plate before striking a baseball. A need exists for a device that will teach proper extension in front of a plate while batting. A further need exists for that same device to assist in warm-up and core strength training and to improve the swings of softball players and golfers.

SUMMARY OF THE INVENTION

All young hitters would like to be able to hit home runs. Unfortunately though, many young hitters believe extension is achieved over the plate, rather than in front of the plate, resulting in a loss of power. To make matters worse, these same young hitters probably work with coaches and instructors who also do not understand that power is achieved by contact in front of the plate. The present invention solves both problems and provides a baseball training aid that teaches hitters how to achieve true extension at the plate. First, the device develops correct hitting fundamentals, developing upper and lower body strength and developing quickness to the point of contact with the backside of the hitters. Second, the device provides a colored stretchable band of resistance tubing that visually indicates proper extension. Coaches are able to use the invention to teach that the color band should provide visual indication of extension before contact with the ball, rather than after. The training provided by the visual indicator results in better performance at the plate by the batter.

This device includes hook and loop harness attachment members, stretchable tethers comprised of high resistance bands, and an intermediate indicator comprised of a resistance band and separable cover comprised of a pair of sleeves. When facing the plate, a first attachment member attaches to the back forearm of the batter. A second attachment member attaches to the back calf, just below the knee, and a third attachment member attaches to the back foot of the hitter about the forefoot of the shoe. The attachment members attach the apparatus to the back arm, leg and foot of the batter so that the bands provide resistance training to the hitter, as well as immediate feedback to the coach observing the hitter. In particular, when the color band of the indicator, previously hidden by the separable cover before extension, is seen prior to the point of contact, then the hitter has achieved true extension in front of the plate. As a result of the proper extension in front of the plate, the batter will experience increased power.

Several variations of the inventions are contemplated, including youth, adult and female models with various length tethers and attachment members. In another variation, the third attachment member for the foot may be removed along with the accompanying tether to provide a less cumbersome configuration. In this alternative configuration, the device may be used while running and may also be removed quickly. With these additional advantages, the device still provides a useful amount of resistance that is beneficial for warm-up and strength improvement. Thus, the alternative configuration without the foot harness can be useful in on-deck situation where time is of the essence, or in practice where more free range of movement is desirable.

The device works well for fast-pitch and slow-pitch softball as well as baseball, and also golf. In golf, the device may be used on the training tee and as a warm-up device that improves confidence before approaching the first tee. In golf training, the device keeps the golfer's back elbow from lifting too far upward, which is undesirable in a proper golf swing. Further, the device provides resistance training in the golf backswing that improves core strength in the golfer and improves balance. The device is particular useful for improving the swing of older golfers. Thus, the device may be adapted to several sports where extension and rotational core strength are an important aspects of swing mechanics.

DETAILED DESCRIPTION OF THE DRAWINGS

Figure 1:
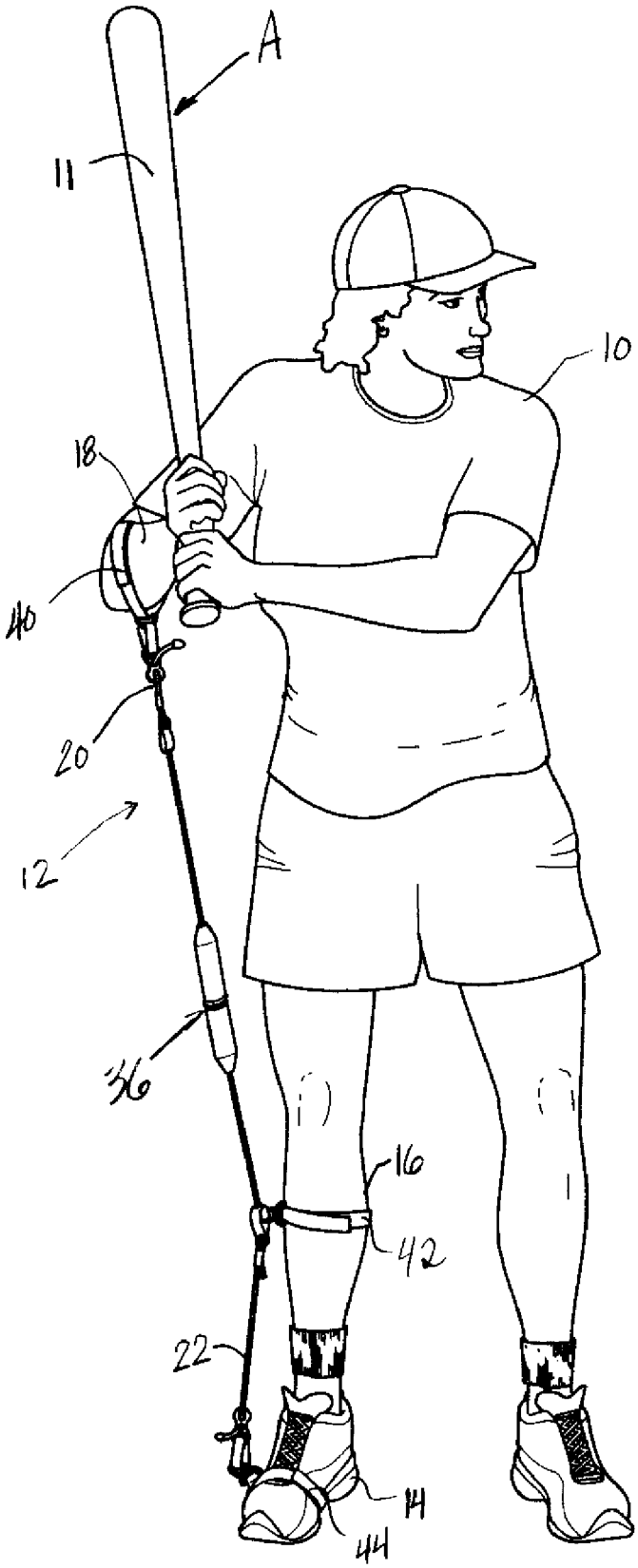
FIG. 1 is a front view of a batter assuming an initial batter's stance while wearing a preferred embodiment of the present invention and illustrating the attachment points of the invention with respect to the batter.

Referring now to the drawings, FIG. 1 shows a batter 10 preparing to hit a ball with the bat 11 up in a ready position (A) with the batter facing inward toward a plate for receiving a baseball or softball pitch. A front side of the batter is directed outward to a pitcher, and a back side of the batter is situated pointing away from the pitcher toward the rear of a batter's box. In the ready position, the training device 12 is attachable to the batter in three locations. In the first location, the training aid is attachable to the batter's back foot shoe 14 about the forefoot. In a second location, the training aid is attachable to the batter's back leg calf 16, just below the batter's knee. In a third location, the training aid is attachable to the batter's back forearm 18, just below the elbow.

Figure 3:
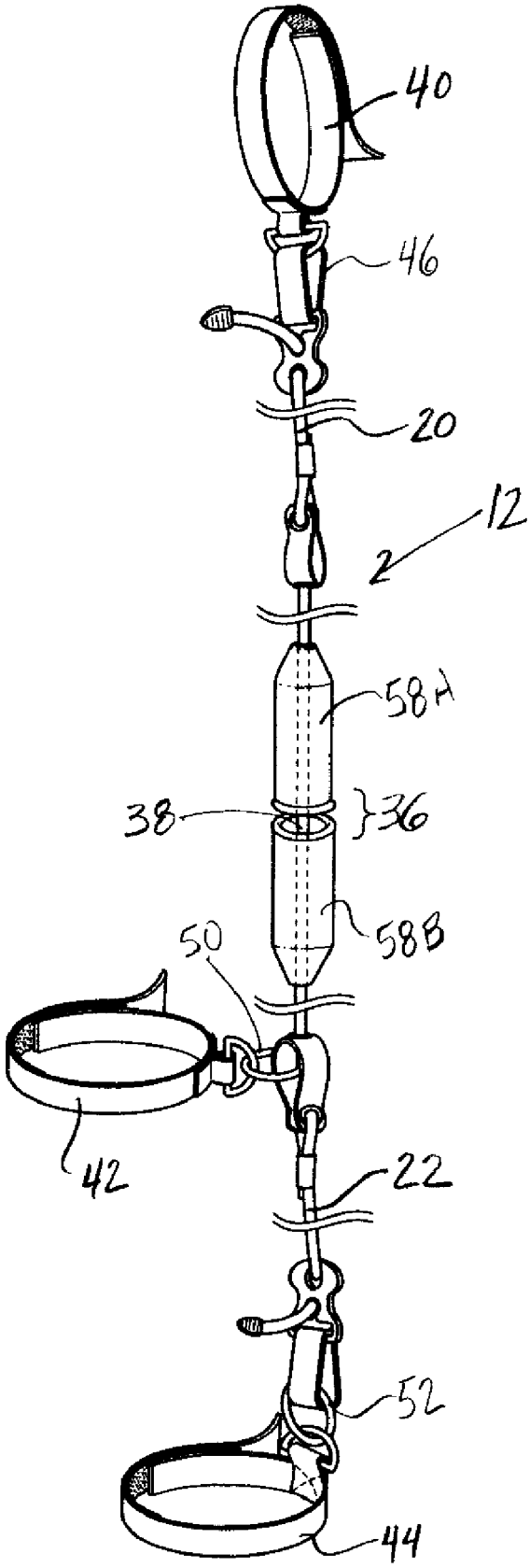
FIG. 3 is a perspective view of a preferred embodiment of the invention.
Figure 4:
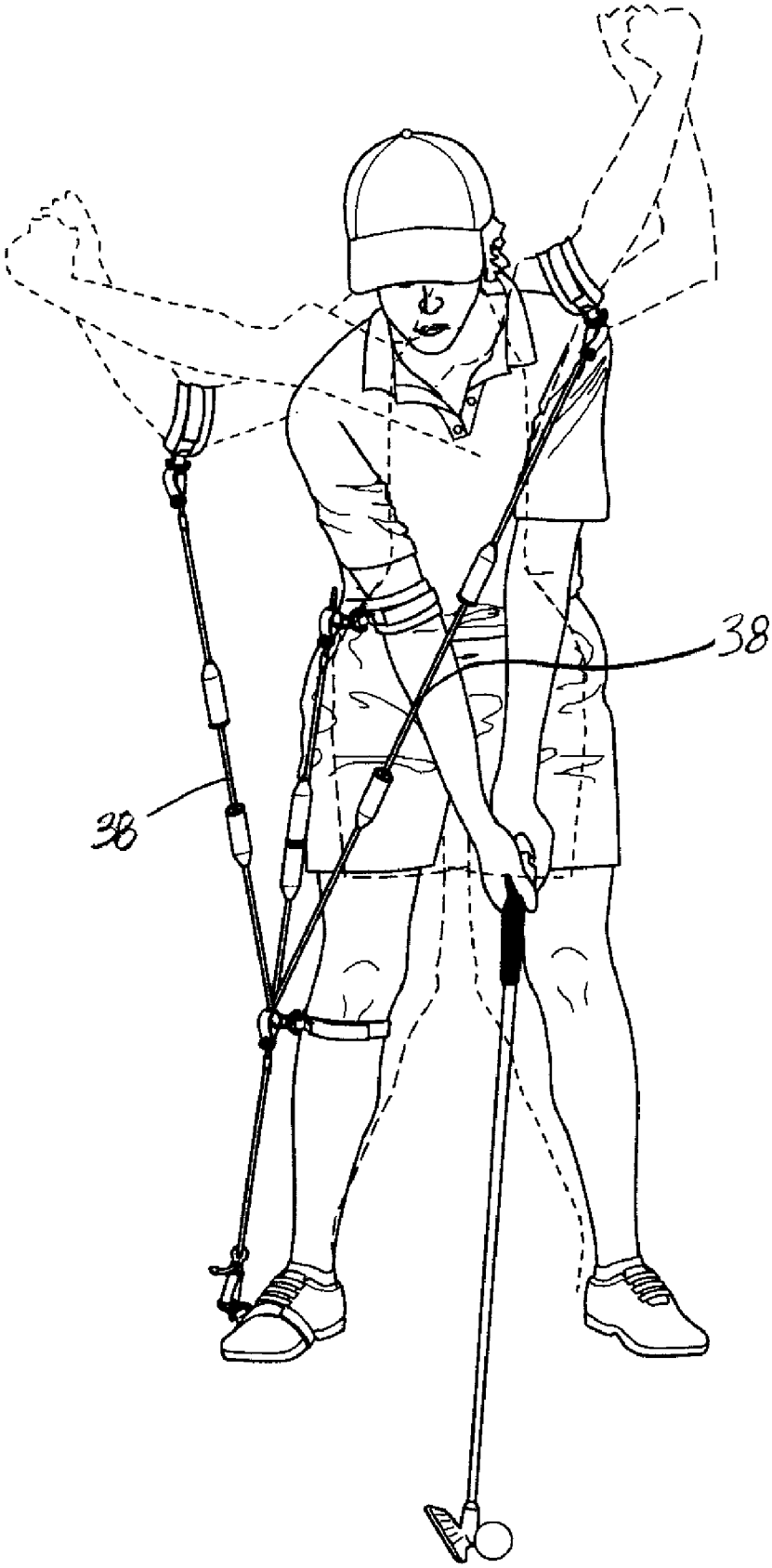
FIG. 4 is a front view of a golfer while wearing a preferred embodiment of the present invention and illustrating the back swing, bottom of the swing and follow through of the golf swing while training with the device.
Figure 5:
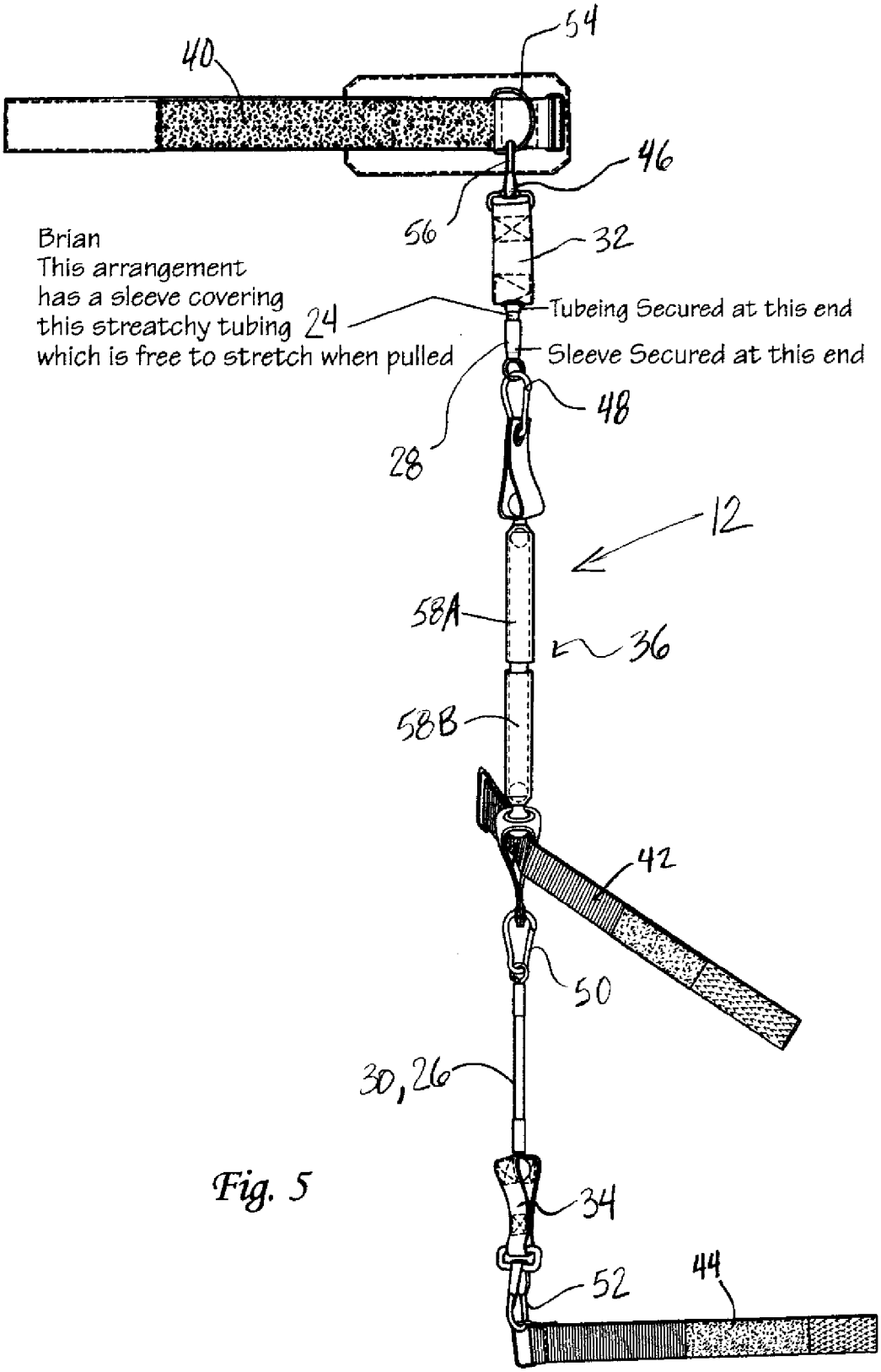
FIG. 5 is a plan view of an adult sized preferred embodiment of the invention.
Figures 6, 7:
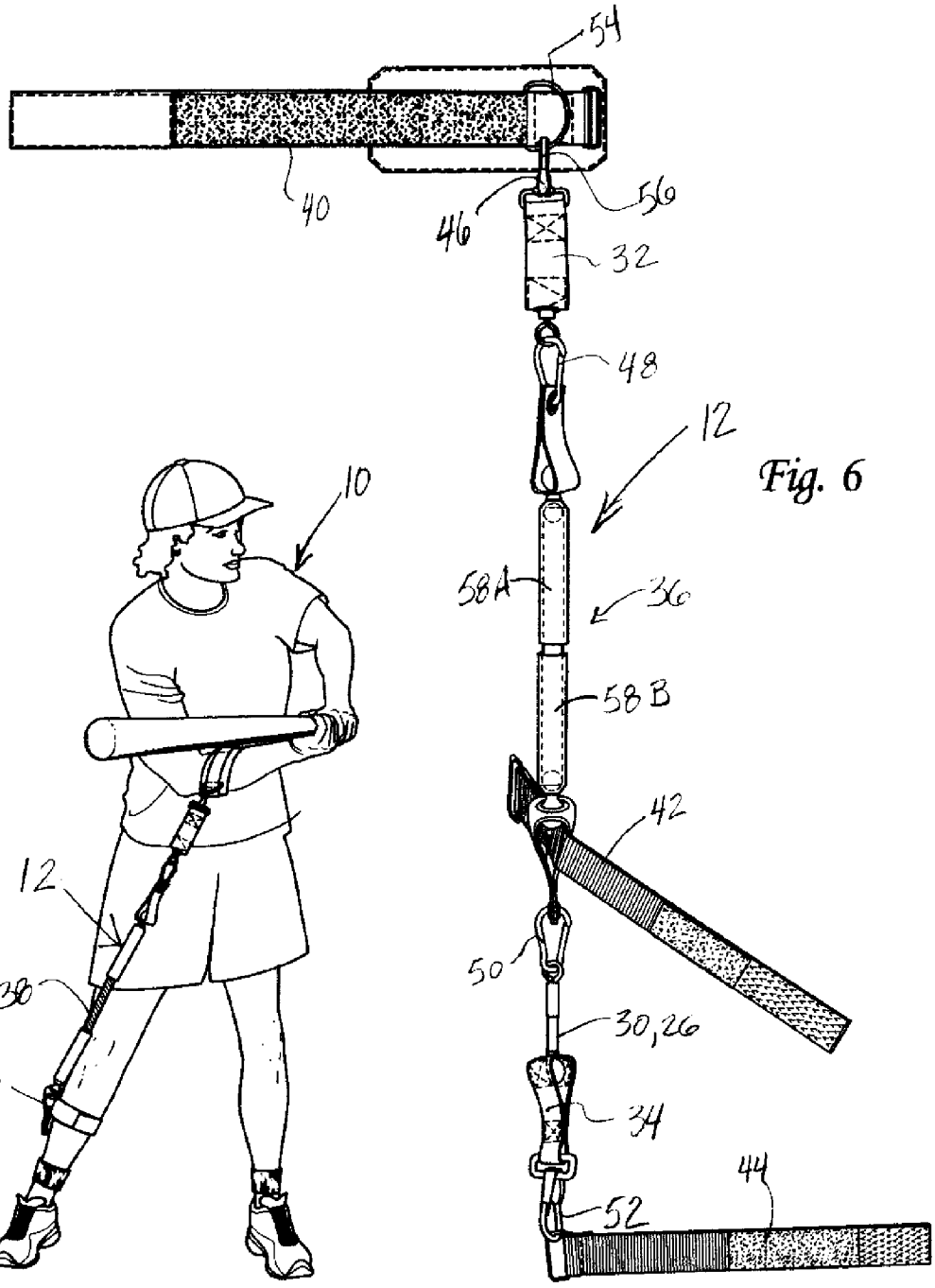
FIG. 6 is a plan view of a youth sized preferred embodiment of the invention.
FIG. 7 is a front view of a batter just prior to striking a ball while wearing an alternative embodiment of the invention.

The training aid includes stretchable bands of resistance tubing between each of the attaching points. The resistance tubing is comprised of a bungee-type tubing selected of desired resistance for each interposed location between attaching points. In the arrangement of FIGS. 1 and 3, the tubing may include first and second tethers of about 10" of heavy weight resistance tubing 20 and 22 that are adjustable in actual length according to the desired size. The preferable color of this heavy weight resistance tubing comprising tethers in this embodiment is black because of industry standards for resistance characteristics and also because of the reduced visibility and the aesthetic quality of the black tubing. The device may be designed with tethers comprised of adjustable lengths of resistance tubing as shown in FIG. 3 or may use fixed length first and second tethers 24 and 26 comprised or made in combination of resistance tubing 28, 30 or canvas-like fabric material 32, 34 according to size as shown in FIGS. 5 and 6. The fabric material may form loops with rings for attachment to hook clasps and may be adjustable to make the tethers variable in length. The variable length of the tethers is adjustable according to preference to adjust the first and second tether to each be taut during a person's initial swinging stance. The lengths of the first and second tethers may approximate the length of the person's forearm to torso and the person's upper calf to foot, respectively.

At about the midpoint of the device between the foot and forearm attachments is an indicator section 36. The indicator section includes a stretchable band structure for indicating when the batter is properly swinging the bat with respect to extension in front of the batter's body. The structure of the indicator section includes an indicating band 38 comprised of red or other highly visible colored resistance tubing that stretches more easily than the resistance tubing 20, 22 or 28, 30 that may be used in the first and second tethers 24, 26. While the batter 10 is in the initial stance and ready position shown in FIG. 1, the indicator section shows that no extension is taking place, which is proper.

Figure 2:
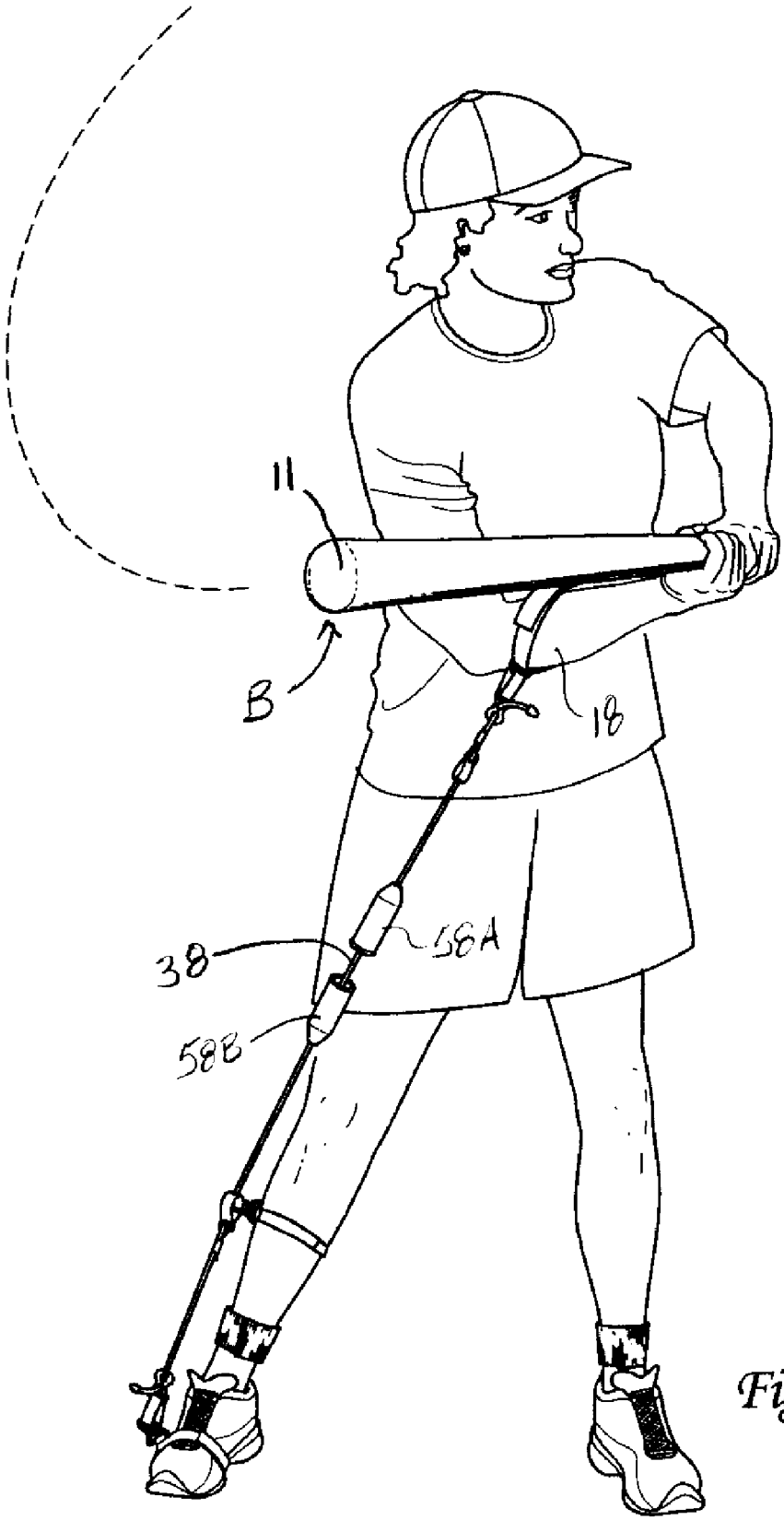
FIG. 2 is a front view of the batter shown in FIG. 1 just prior to striking a ball.

Referring to FIG. 2, a batter 10 is shown half-way through her swing into a position (B) while extending the bat 11 out in front of the body through proper hip rotation initiated by the front foot. As the batter extends the bat out in front of her body, the distances between the batter's elbow, calf and foot lengthens. As a result, the stretchable bands extend, and as the bands extend, the indicator section 36 extends as well causing the indicator section to signal proper extension through a visually stimulating indicator band 38 that becomes visible.

FIG. 3 shows the details of an embodiment of the apparatus. An adjustable first attachment member 40 is attachable to the forearm 18 just below the elbow. The first attachment member is comprised of a length of fabric material that extends through a first ring to which the first tether is connected to the first ring 54 by a first hook clasp 56. The second attachment member 42 comprises a second length of fabric material affixed to a second fabric loop 33 to which the stretchable band of the indicator means is connected. The second attachment member connects to the calf 16 of the person swinging just below the knee. The second attachment member addresses a problem in which the tubing of the device can encroach and twist into the inside of the batter's leg improperly. The second attachment member keeps the tubing safely to the outside of the leg. A third adjustable attachment member 44 comprises a third length of fabric material and provides a foot ring that is attachable to the foot about the forefoot of a shoe 14. The second attachment member 44, of about 14" preferred strap length, slides onto the shoe and is secured with a hook and loop fastener strap over the middle of the shoe. The third attachment member 44 secures the device between the two outermost longitudinal ends of the training aid 12 as attached at the foot 14 and arm 18 to provide a sturdy fit for the training aid. Each of these attachment member straps are secured to the training aid by suitable eyelets, rings, loops of fabric or physically attached. The attachment members may be comprised of ends with cooperating hook and loop material on opposite surfaces so that overlapping the ends to a predetermined degree and bringing the cooperating hook and loop material together will form a closed ring of predetermined circumference to fit about the forearm, leg or shoe. As shown in FIG. 5, the second attachment member may be sewn to a fabric loop 33 to which the stretchable band 38 is attached.

A first interposed elongated tether 20 or 24 having first and second opposing ends is connected between the first attachment member 40 and second attachment member 42. As shown in FIGS. 5 and 6, the first tether may include an elongated fixed length portion of fabric 32 and an elongated stretchable portion of resistance tubing 28 longitudinally aligned to form the length of the first tether 24, except where the resistance tubing portion may be removed as discussed further below. The fabric portion 32 is attached to the resistance tubing portion 28 and links the tubing to a first fabric loop 46. The first end of the first tether 24 connects by the first connector to the first attachment member 40, and the second end of the first tether attaches to a second connector 48. The second connector links the first tether to a first end of the intermediate indicator member 36.

A second end of the intermediate indicator member 36 connects to a third connector 50, which links the indicator member to the second attachment member 42. A second interposed elongated stretchable tether 22 or 26 having first and second opposing ends connects at the first end by the connector 50 to the second attachment member, and the second end of the second tether attaches to a fourth connector 52 linking the second tether to the third attachment member 44. The second tether 26 includes an elongated extensible resistance tubing portion 30 that is attached to and longitudinally aligned with an elongated fixed length fabric loop 34, which links the tubing to the third connector 52. The tubing 30 of the second tether 26 is in a parallel alignment with the batter's shin to where the second attachment member 42 is secured at the second connector 50. The second attachment member 42, attachable at the calf, and the third attachment member 44, attachable at the foot, cooperate to keep the second tether 26 and indicator member 36 on the outside of the knee and the outside of the foot. Each of the connectors comprise clasps, clamps, sewn on rings, or ball-joints that permit the tethers and indicator member to be longitudinally aligned. In particular, the connector linking the first attachment member 46 to the first tether 24 may include a ring 54 in combination with a spring clasp 56. The combination of ring and spring clasp permit the spring clasp to slide about the ring so that the first attachment member 40 moves the clasp about the ring 54 in accordance with the motion of swing of the arm where the device is attached.

The first attachment member 40 is dimensioned to form a forearm loop for attachment to the trailing arm 18 of the batter 10 at a point below the elbow during use. The second adjustable attachment member 42 is dimensioned to form a calf loop for attachment to the calf 16 at a point below the knee during use. The third adjustable attachment member 44 is dimensioned to form a shoe loop for attachment to the foot about the forefoot. The length of each adjustable attachment member is modifiable according to size. For instance, the calf ring second attachment member 42 may be about 12" in length for a youth sized training aid and about 16" length in an adult sized aid. The straps of the first and third attachment members 40, 44 may be constructed of identical length and material to promote efficiency in assembly and production.

The indicator member 36 is interposed between the first tether 24 and the second adjustable attachment member 42, which is about midway about the longitudinal length of the apparatus 12. The indicator member 36 includes an elongated stretchable band 38 of resistance tubing that stretches. While in the embodiment shown the elongated stretchable band 38 is about 10" long, it is understood that the length of the cord is readily modified for the size of the training aid or resistance thereof. Thus, variations of tubing resistance and cord length are contemplated. The stretchable band 38 stretches more easily than the cords used in the first and second tethers 24, 30. The stretchable band 38 is covered by a lightweight two-part sleeve 58A-B forming a cover that is split in about the center and constructed to completely cover the stretchable band when the device is not extended. The sleeve 58A-B is attached at first and second opposing ends of the stretchable band 38. When the stretchable band is relaxed, the sleeve 58A-B completely covers the stretchable band. Whereas, when the stretchable band 38 is stretched and extended, the split sleeve 58A-B separates and pulls apart to reveal a portion of the stretchable band previously masked by the sleeve. The stretchable band 38 is color coded, such as red, to be highly visible and, therefore, provide a visible indicator of proper extension when swinging. Red resistance tubing has a predetermined resistance in the industry that has been found to have an excellent resistance value for an embodiment of the invention as discussed.

FIG. 5 illustrates an adult-sized arrangement of the apparatus. In the adult version, the length of the second stretchable band 26 and connectors 50, 52 between the second and third attachable members 42, 44 is about 15 inches or more. Further, the length of the first tether 24 includes a stretchable band 28 between connectors 46, 48. Whereas, FIG. 6 illustrates an alternative youth or female arrangement of the apparatus in which the second stretchable tether 30 and connectors 50, 52 are a length of about 14 inches or less. Further, the stretchable band 28, shown in FIG. 5, is removed from the first tether 24, reducing the first tether from about 15 inches to 12 inches, thereby further shortening the overall length of the device 12.

In FIG. 7 the second tether 30 and third attachable member 44 are removed from the device 12. A quick disconnection connector 50 links the second tether to the second attachment member 42. By quickly disconnecting the second tether 30, the tether and third attachable member 44 are conveniently removed for use of the device with only the first and second attachment members 40, 42 attached to the batter 10. This configuration without the second tether 30 is useful for resistance training and on-deck warmup. The indicator member 36 still provides indication of proper extension in front of the plate, while the device 12 provides resistance for warming up in a manner to increase bat speed and, thus, increase power. By removing the foot harness and second tether, the batter 10 can leave the device on and run by sprinting bases without concern with tripping, or the batter can quickly remove the first attachment member 40 and second attachment member 42 quickly enough to use the device 12 while on-deck.

Another feature of the invention is that the first attachment member 40 strap may be quickly removed. Removing the first attachment member from the forearm 18 allows the batter 10 to drop the upper section of the device 12 without taking the entire device off, and dropping the upper section allows the arms to swing freely to do comparison and contrast tests on bat speed.

While the invention has been illustrated and described as embodied in a swing training aid, it is not intended to be limited to the details shown, since it will be understood that various omissions, modifications, substitutions and changes in the forms and details of the device illustrated and in its operation can be made by those skilled in the art without departing in any way from the spirit of the present invention.

I claim:

1. A device for training in swinging and batting activities comprising:

a first attachment member;

a second attachment member;

a third attachment member;

a stretchable band for connecting between said first and second attachment members;

a cover comprising first and second sleeves;

said cover covering said stretchable band with said separable sleeves initially abutting each other and said first and second sleeves separating when the stretchable band is stretched to provide a visible gap between the first and second sleeves;

a first tether connecting the first attachment member to the stretchable band; and a second tether connecting the second attachment member to the third attachment member.

2. A device for training in swinging and batting activities as in claim 1 in which the stretchable band is comprised of resistance tubing.

3. A device for training in swinging and batting activities as in claim 2 in which the second tether is comprised of resistance tubing.

4. A device for training in swinging and batting activities as in claim 3 in which the resistance tubing in the stretchable band provides less resistance to stretching than the resistance tubing in the second tether.

5. A device for training in swinging and batting activities as in claim 2 in which the resistance tubing is a highly visible color.

6. A device for training in swinging and batting activities as in claim 1 in which the first tether and the second tether are each comprised of resistance tubing.

7. A device for training in swinging and batting activities as in claim 1 in which the first tether is comprised of a fabric member of fixed length, and the second tether is comprised of resistance tubing.

8. A device for training in swinging and batting activities as in claim 1 in which the first tether and the second tether are both adjustable in length and have variable length according to preference to adjust the first tether to be taut during a person's initial swinging stance and to adjust the second tether to be taut during a person's initial swinging stance.

9. A device for training in swinging and batting activities as in claim 1 in which said first attachment member comprises a first length of fabric material extending through a first ring to which said first tether is connected to the first ring by a first hook clasp, said first fabric material length having ends with cooperating hook and loop material on opposite surfaces so that overlapping said ends to a predetermined degree and bringing said cooperating hook and loop material together will form a closed ring of predetermined circumference, and said first tether including a second ring to which said first tether is connected to a second hook clasp that is connected to a first fabric loop that is connected to said stretchable band;

said second attachment member comprises a second length of fabric material affixed to a second fabric loop to which said stretchable band is connected and said second tether is connected to the second fabric loop by a third hook clasp, said second fabric material length having ends with cooperating hook and loop material on opposite surfaces so that overlapping said ends to a predetermined degree and bringing said cooperating hook and loop material together will form a closed ring of predetermined circumference, and said second tether connected to a third fabric loop that is connected to a fourth hook clasp; and said third attachment member comprises a third length of fabric material extending through a third ring to which said fourth hook clasp is attached for connection of the third attachment member to the third fabric loop, said third fabric material length having ends with cooperating hook and loop material on opposite surfaces so that overlapping said ends to a predetermined degree and bringing said cooperating hook and loop material together will form a closed ring of predetermined circumference.

10. A device for training in swinging and batting activities as in claim 9 in which the highly visible color is red.

* * * * *